US005870964A

United States Patent [19]

Gerber et al.

[11] Patent Number: 5,870,964

[45] Date of Patent: Feb. 16, 1999

[54] PORTABLE UNIT TRAY FLOATING DOCK

[75] Inventors: Dennis J. Gerber; Scott D. Gerber, both of Lake Shore, Minn.

[73] Assignee: Gerco, Inc., Lake Shore, Minn.

[21] Appl. No.: 834,448

[22] Filed: Apr. 15, 1997

[51] Int. Cl.[6] ..... B63B 35/44

[52] U.S. Cl. ..... 114/263; 114/267

[58] Field of Search ..... 114/258, 259, 114/263, 264, 265, 266; 405/218, 219

[56] References Cited

U.S. PATENT DOCUMENTS

| | | | |
|---|---|---|---|
| 1,901,545 | 3/1933 | Wood | 114/352 |
| 3,521,588 | 7/1970 | Atlas | 114/263 |
| 4,418,634 | 12/1983 | Gerbus | 114/263 |
| 4,660,495 | 4/1987 | Thompson | 114/263 |
| 5,735,097 | 4/1998 | Cheyne | 114/263 |

*Primary Examiner*—Stephen Avila
*Attorney, Agent, or Firm*—Dwight N. Holmbo

[57] ABSTRACT

A maintenance free, easy to install portable dock system has a rotational molded shell constructed of a UV resistant, linear low density polyethylene. The dock shell includes a plurality of internal columnar truss supports strategically located to provide structural integrity. An "L" or "T" pier type or floating type dock can be formulated simply by coupling a desired number of dock shells together in a desired configuration via a full width self-aligning latching structure which does not require the hand and eye coordination generally required for known dock structures. The dock shell has support beams which run longitudinally over the entire length of the dock shell. Metal stringers are inserted into the outer most support beams to further enhance the structural integrity and increase the rigidity of the dock shell. Buoyancy for the dock shell is ensured with a polyurethane foam which is injected into the dock shell.

6 Claims, 6 Drawing Sheets

PORTABLE UNIT TRAY FLOATING DOCK

BACKGROUND OF THE INVENTION

1. Field of the Invention

The present invention relates generally to dock systems, and more particularly to a non-wood, portable buoyant rotational molded dock system having all necessary structural, floatation, and latching features integrated into a single piece maintenance free dock section.

2. Description of the Prior Art

Buoyant dock systems familiar to those skilled in that art are generally constructed of wood, as wood has customarily been the material of choice to make up the majority of docks that are pier-type in nature. Wood has disadvantages however, such as the perpetual necessity to maintain the surface of the wood in a manner which prevents rotting or otherwise to remove dirt and oils because the rate of wood degradation in a wet environment is significant when compared with man made materials such as plastic. It is well known for example, that wooden docks commence deteriorating immediately upon use. Furthermore, slivers and abrasions caused from sharp edges and fasteners are common hazards associated with wood docks.

It is now well accepted that materials such as aluminum in combination with plastic decking can be utilized to construct docks that are very weather resistant. Generally, these docks are not of a buoyant design and are therefore difficult to install. It is well known that such docks are also very costly to fabricate.

What is needed is a type of one piece rotational molded dock system having all necessary structural, floatation and latching systems integrated into a rugged, light weight and maintenance free dock section. The dock section should have sufficient buoyancy to accomplish easy installation and should have a latching structure which promotes ease of alignment and coupling with other like dock sections. All necessary structural support should be an integral feature of each dock section which should also have side stringers acceptable for accepting a variety of hanger brackets to accommodate portable installations or installations where permanent "H" post arrangements are employed.

SUMMARY OF THE INVENTION

The present invention is directed to a dock system including a unitary rotational molded dock section having all necessary structural, floatation and latching systems integrated into a rugged, light weight and maintenance free dock section. The dock section is manufactured via a rotational molding process in which a mold is filled with an ultraviolet stabilized linear low-density polyethylene (LLDPE) and processed to form a shell. Subsequent to molding, a single steel side stringer is installed into each side of the shell, which is then filled with a polyurethane foam. The steel side stringers have approximately the structural integrity of a 2"×6" wooden beam and provide a mounting structure for riser brackets to be located on the outside surface of the dock section. The polyurethane foam provides the necessary structural integrity necessary to make a strong, easy to install dock section. The polyurethane additionally ensures dock buoyancy and prevents water seepage into the dock shell. The dock section is lighter than conventional wooden docks of the same size and additionally eliminates maintenance and safety hazards normally associated with wood surface dock fastening members.

The rotational molded dock section has self-aligning, integral hinging latches making alignment of dock sections very easy through elimination of hand and eye coordination normally required when installing most dock systems. The full width hinge system reduces the "sway" normally found in convention dock systems using add-on hardware.

An adapter/end cap allows the rotational molded dock section to be easily installed in either a "T" or an "L" configuration when used with other dock sections. This feature provides easy access to various other water accessory system, e.g. boat lifts, PWC floats, etc.

A feature afforded by the present invention is the provision of a modular pier type buoyant dock section that is molded, resulting in a one-piece panel section that is relatively strong and light weight.

Another feature afforded by the present invention is the provision of a modular pier type buoyant dock section that is ultraviolet light stabilized to provide permanent resistance to fading.

Yet another feature afforded by the present invention is the provision of a modular pier type buoyant dock section having full width integrally molded panel latches to reduce sway between dock sections when joined together.

Still another feature afforded by the present invention is the provision of a modular pier type buoyant dock system which is easy to align during installation and which has no sharp edges to catch or pinch.

Another feature afforded by the present invention is the provision of a modular pier type buoyant dock system which eliminates the need for fastening devices which can come loose, require nuisance maintenance, or which can cause instability.

Another feature afforded by the present invention is the provision of a modular pier type buoyant dock system having the appearance of wood without the undesirable slivers normally associated with wood.

Another feature afforded by the present invention is the provision of a modular pier type buoyant dock section having hand grips that facilitate an ergonomically correct wrist position for lifting and handling.

Another feature afforded by the present invention is the provision of a modular pier type buoyant dock system that is maintenance free since all necessary assembly components are fastened, bound or joined continuously into a single body.

Another feature afforded by the present invention is the provision of a modular pier type buoyant dock system that is sound absorbing when walked upon.

Still another feature afforded by the present invention is the provision of a modular pier type buoyant dock section having a crown molded into the dock section, running the entire width and length such that water run-off is enhanced, thereby providing a safer and cleaner dock section.

BRIEF DESCRIPTION OF THE DRAWINGS

Other features of the present invention and many of the attendant advantages of the present invention will be readily appreciated as the same becomes better understood by reference to the detailed description when considered in connection with the accompanying drawings in which like reference numerals designate like parts throughout the figures thereof and wherein.

While the above-identified drawing figures set forth alternative embodiments, other embodiments of the present invention are also contemplated, as noted in the discussion. In all cases, this disclosure presents illustrated embodiments of the present invention by way of representation and not limitation. Numerous other modifications and embodiments can be devised by those skilled in the art which fall within the scope and spirit of the principles of this invention.

DETAILED DESCRIPTION OF THE PREFERRED EMBODIMENT

The preferred embodiment described herein below, addresses the long felt need by those in the pier and floating dock industries to provide a portable buoyant pier type dock system which is both maintenance free and easy to install and which further selectively serves as a pier type dock system or a floating dock system. Although each of these issues has often been individually addressed in specific dock systems, these issues have not yet been successfully addressed in a single dock system. The present invention addresses these issues by providing a one piece rotational molded dock section having all necessary structural, floatation and latching systems integrated into a rugged, light weight and maintenance free dock section.

Figure 1:
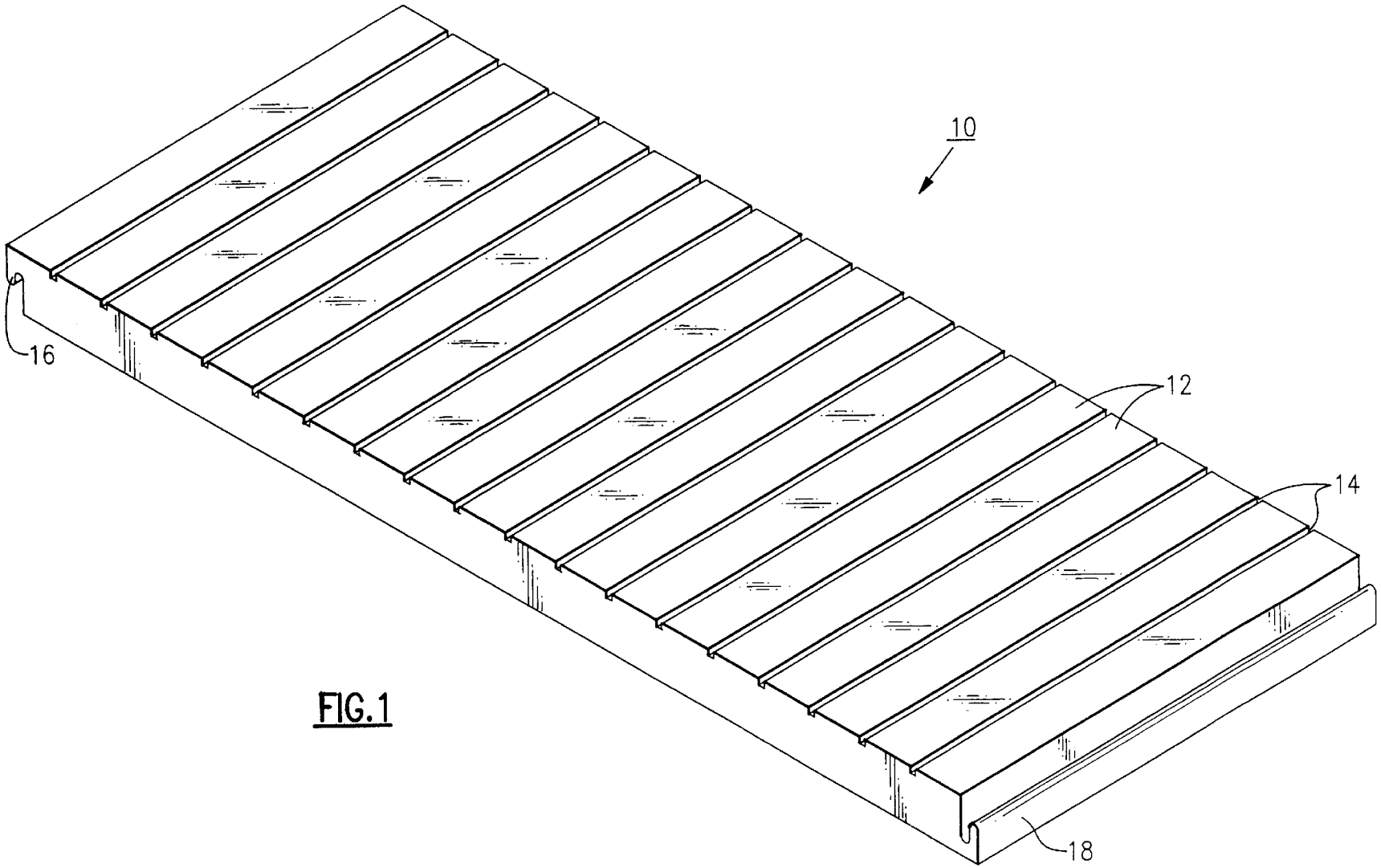
FIG. 1 illustrates a perspective view for one embodiment of the present inventive rotationally molded dock section.

Referring now to FIG. 1, a perspective view for one embodiment of the present inventive rotationally molded dock section 10 is illustrated. The novel dock section 10 is most preferably manufactured via a rotational molding process wherein a mold is filled with an ultraviolet stabilized linear low density polyethylene and thereafter processed to form the shell depicted in FIG. 1. The present invention is not so limited however, and it will readily be appreciated by those skilled in the art that other manufacturing processes may also be used to mold the dock section 10, e.g. blow molding, etc. The surface of the dock section 10 preferably replicates natural wood planks 12. The simulated wood planks 12 are separated via grooves 14 which serve as rain troughs to help retain the slip resistance characteristics of the walking surface created by a deeply molded wood grain surface finish. Most preferably, a "crown" is molded into the dock section 10, running the width and length of the dock section 10 to enhance water run-off thereby providing a safer and cleaner dock section 10. The dock section 10 has a continuous downward facing latch hinge 16 at one end as well as a continuous upward facing latch hinge 18 at its other end for coupling multiple dock sections 10 together to selectively form a pier type or floating dock of desired length and shape.

Figure 2:
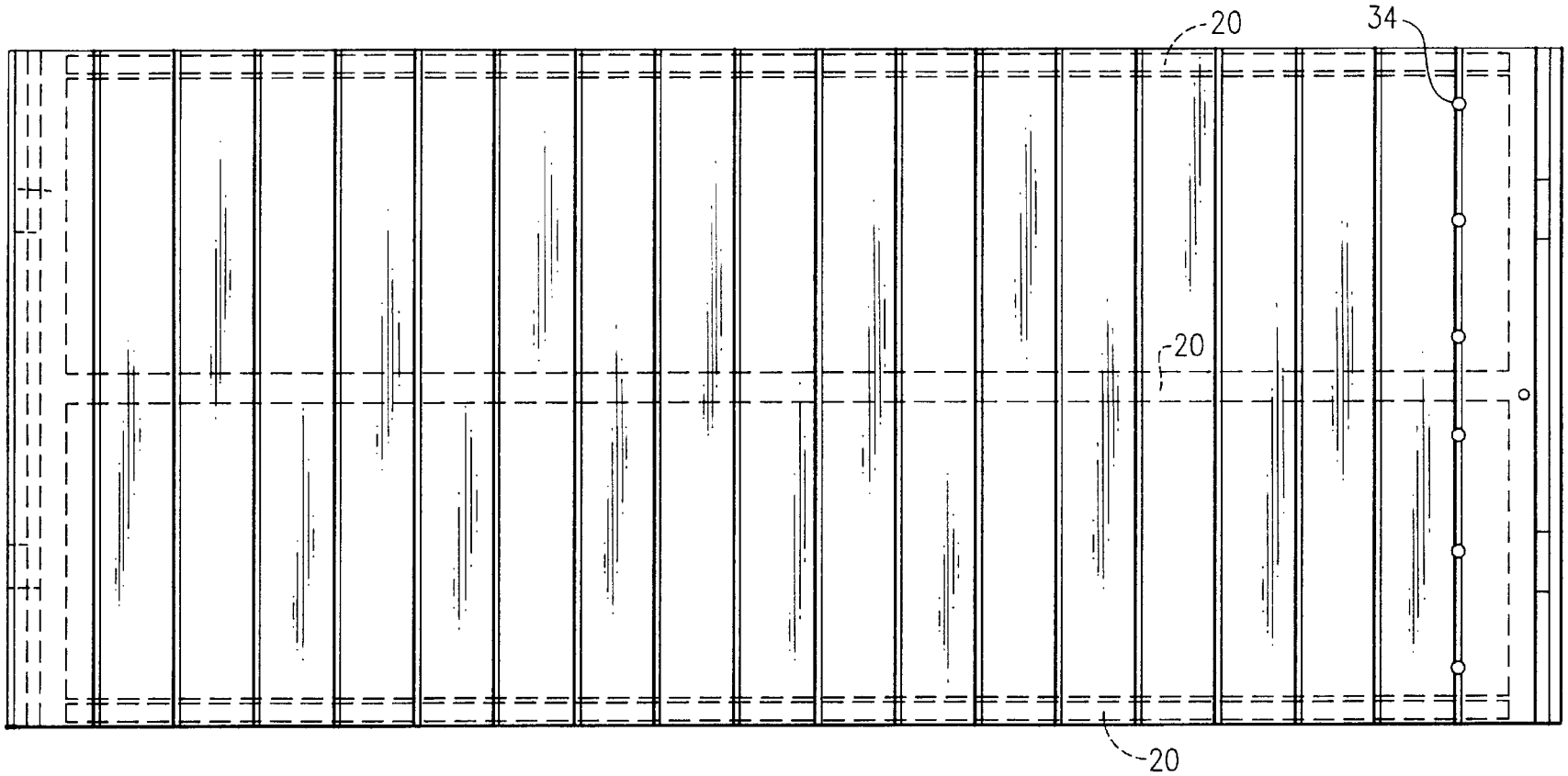
FIG. 2 is a top view of the rotationally molded dock section depicted in FIG. 1.

FIG. 2 is a top view of the rotationally molded dock section 10 depicted in FIG. 1. The shell of the dock section 10 has two outer and one centered support beam 20 running the entire length of the dock section 10 to provide added strength and stability. As stated herein above, a low density polyethylene (LLDPE) shell is most preferably used to provide strength and durability. The present invention is not so limited however, and it shall be understood that high density polyethylene, medium density polyethylene as well as non-polyethylene materials can also be utilized so long as the necessary functional shell strength and stability are retained. Urethane foam filling inserted into the shell of the dock section 10 ensures buoyancy and additional support. "Kiss-offs" 34, familiar to those skilled in the molding art, are integrated into the internal shell of the dock section 10 to act as supporting structures by serving as trusses throughout the upper decking surface of the dock section 10. Although a particular number and pattern of "kiss-offs" 34 have been depicted in FIG. 2, it will be appreciated that the present invention is not so limited and that any number of alternate patterns and quantities of "kiss-offs" 34 may just as well be utilized to provide the intended structural support. The present inventors found a pattern including 108 "kiss-offs" 34 adequate to provide a satisfactory workable structure.

Figure 3:
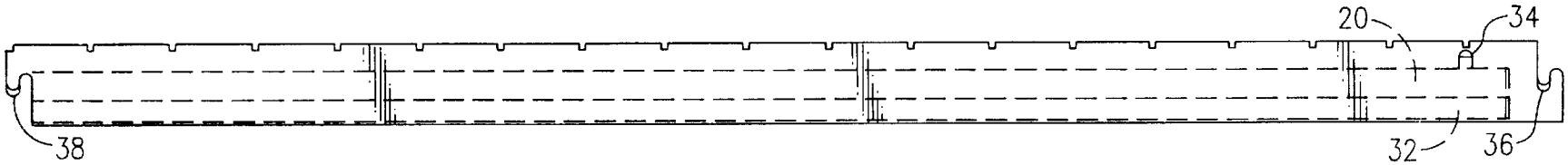
FIG. 3 is a side elevational view of the rotationally molded dock section depicted in FIG. 1.

FIG. 3 is a side elevational view of the rotationally molded dock section 10 depicted in FIG. 1. The aforesaid "kiss-offs" 34 can be seen to be centered beneath the separation grooves 14. Positioning the "kiss-offs" 34 directly beneath the separation grooves 14 was found most preferable to provide the required structural rigidity of the dock section 10. The "kiss-offs" 34 form an integral part of the dock section 10 and are molded to be permanently attached to the internal lower and upper surfaces of the shell of the dock section 10. In addition to providing further structural support, the "kiss-offs" 34 also provide increased internal surface area for the aforesaid urethane foam fill to adhere to, which provides even further structural rigidity to the overall structure of the dock section 10.

Each dock section 10 most preferably has a steel support stringer 32 inserted into each outer most support beam 20 to provide additional structural integrity for the dock section 10. Most preferably, the support stringers 32 are selected to simulate the approximate structural integrity of a 2"×6" wooden beam and to provide a mounting point for attachment of riser brackets located on the outside surface of the dock section 10. Preferably, the support stringers 32 are formed of 1.5"×1.5" rectangular steel tubing. More preferably, the support stringers 32 are formed of a length of metal angle stock. Most preferably, the support stringers 32 are formed of a sheet metal angle. The present embodiment worked best with a sheet metal angle ⅝"×4¼" with the ⅝" lip resting against the under side of the top surface of the dock section 10 to provide the maximum additional structural support, rigidity and integrity.

Figure 4:
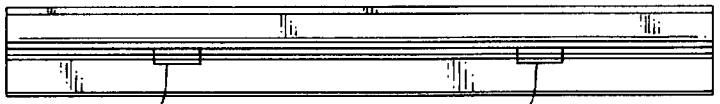
FIG. 4 is an end elevational view of the downward facing flange end of the rotationally molded dock section depicted in FIG. 1.

FIG. 4 is an end elevational view of the downward facing flange end of the rotationally molded dock section 10 depicted in FIG. 1. As stated herein above, a full width integral latching system eliminates secondary hardware, promotes ease of installation, and minimizes "sway" and "give" commonly occurring with use of secondary hardware. This latching system includes a downward facing flange 16 which forms one end of the dock section 10. Each downward facing flange 16 has one or more extension fingers 38 for mating with other like dock sections 10. Usually, the alignment of each pier in a conventionally constructed dock is difficult, imprecise, and time consuming. The present inventive self aligning system does not require the hand and eye coordination normally associated with such conventionally constructed pier dock systems.

Figure 5:
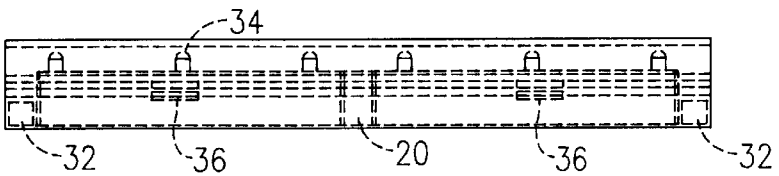
FIG. 5 is an end elevational view of the upward facing flange end of the rotationally molded dock section depicted in FIG. 1.

FIG. 5 is an end elevational view of the upward facing flange end of the rotationally molded dock section 10 depicted in FIG. 1. The aforesaid full width integral latching system also includes an upward facing flange 18 at one end of the dock section 10. The inner channel of the upward facing flange 18 has one or more latching pockets 36 which are sized and positioned to removably accept and mate with the aforesaid extension fingers 38 when multiple dock sections 10 are latched together. The downward facing flange 16 including its associated extension fingers 38, as well as the upward facing flange 18 including its associated latching pockets 36, therefore combine to form the novel latching structure for the present inventive dock section 10.

Figure 6:
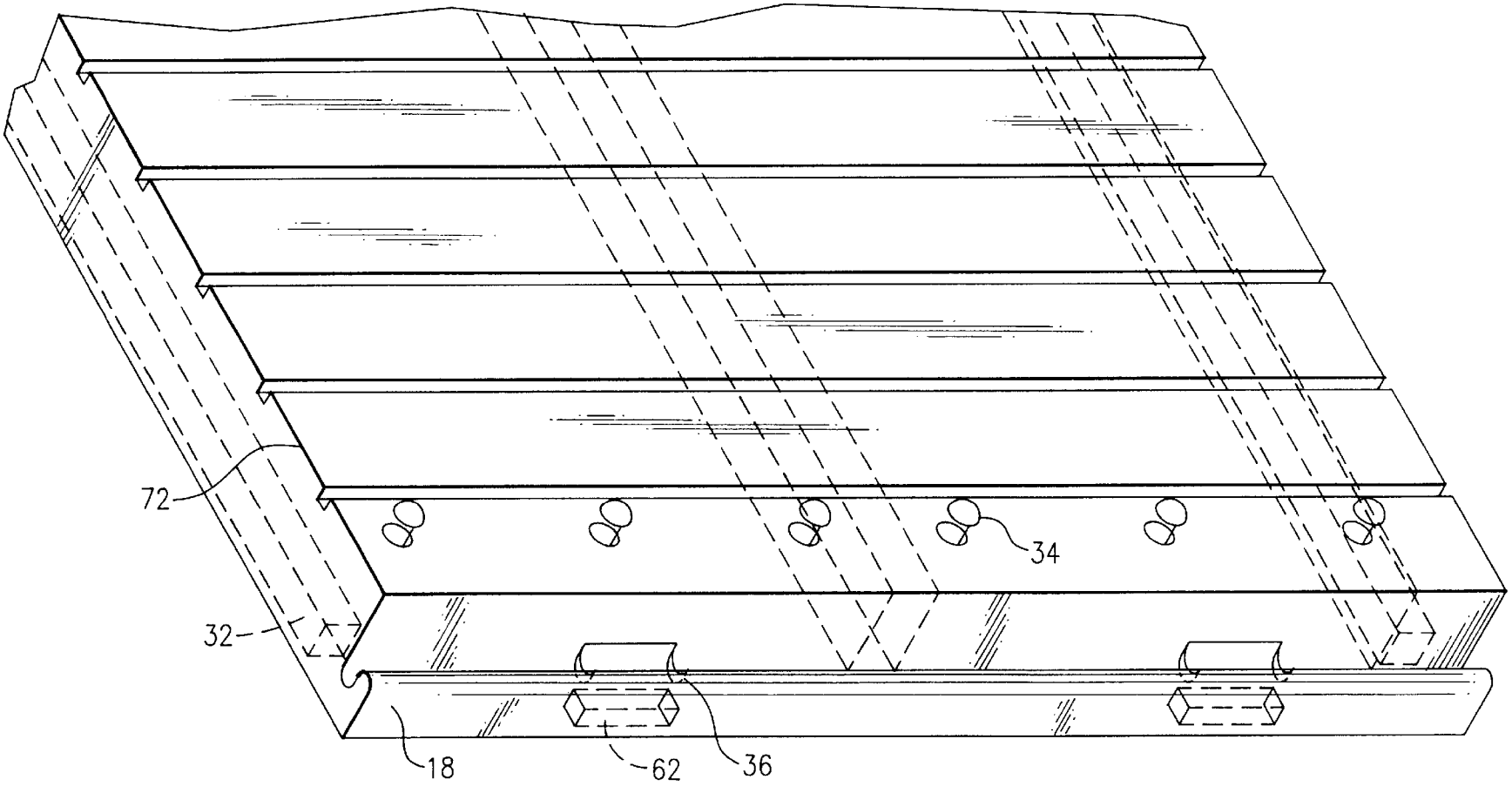
FIG. 6 is a more detailed perspective view of the upward facing flange end of the rotationally molded dock section depicted in FIG. 1.

FIG. 6 is a more detailed perspective view of the upward facing flange end of the rotationally molded dock section 10 depicted in FIG. 1. The aforesaid steel rectangular tubing or other metal structure which forms the support stringers 32 runs the entire length of the dock section 10. Subsequent to formation of the shell 72 of each dock section 10, insertion holes are drilled into a selected end of the dock section 10 and utilized to insert the support stringers 32 into the shell 72 prior to injecting the urethane foam filling used to ensure the needed buoyancy. The urethane foam is most preferably injected into the shell 72 through the same holes through which the support stringers 32 are inserted. The present inventors found that a foam density of approximately two pounds per cubic foot provided the necessary support for the deck surface and also added structural strength. As stated herein before, the shell 72 is most preferably formed of a permanently impregnated UV resistant polyethylene to provide a surface that does not require cleaning and surface treatment to prevent deterioration. Lift handle pockets 62 are molded into the end of the dock section 10 just below the latching pockets 36. These lift handle pockets 62 provide for easy lifting and a stable grip when maneuvering the dock section 10. Lift handle pockets 62 are only required on the end of the dock section 10 having upward facing flanges 18, since the downward facing flanges 16 on the opposite end of the dock section 10 also serve as lift handles. Preferably, the surface of the dock shell 72 is a replica of wood, having a deeply molded wood grain finish. A deeply molded wood grain finish does not have the maintenance requirements or the safety hazards of ordinary wood surfaces. The "kiss-offs" 34, which are formed as part of the shell 72 during the molding process, are fused to the underside of the top surface of the dock shell 72, as stated above, to form a truss network within the body of the dock shell 72 and provide increased internal surface area for the urethane foam fill to adhere to.

Figure 7:
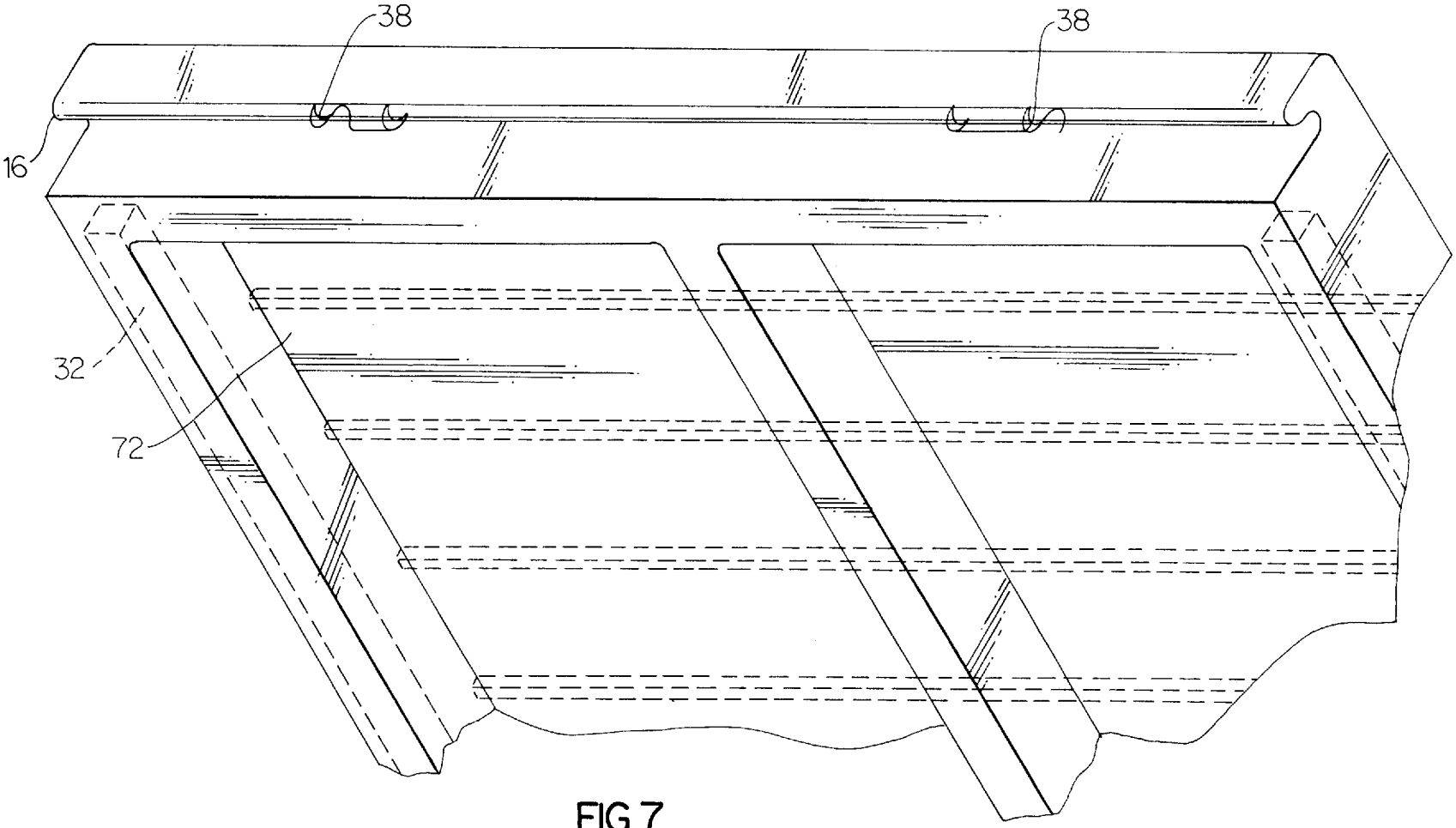
FIG. 7 is a more detailed perspective view of the downward facing flange end of the rotationally molded dock section depicted in FIG. 1.

FIG. 7 is a more detailed perspective view of the downward facing flange end of the rotationally molded dock section 10 depicted in FIG. 1. The extension fingers 38 are integrally molded as part of the dock shell 72 during the molding process, and, as stated herein before, form part of a latching system 16, 18, 36, 38 which does not require the hand and eye coordination of conventional dock systems known in the art. The novel latching system 16, 18, 36, 38 does not require even a single fastening device, thereby eliminating the necessity to maintain fasteners such as used with conventional wooden systems, and which tend to loosen as wood shrinks and grows. Therefore, the present dock section 10 provides enhanced rigidity and safety when compared with conventional dock systems known to those skilled in the art.

Figure 8:
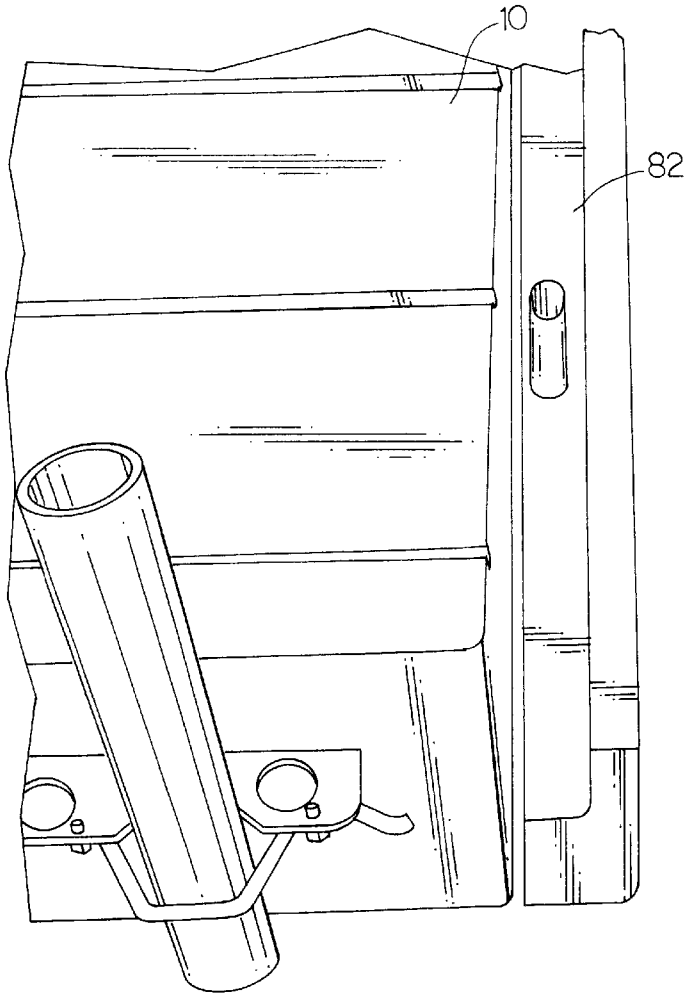
FIG. 8 is a perspective view illustrating use of an adapter bracket in combination with the dock section depicted in FIG. 1 suitable to form either "L" or "T" shaped docks.

FIG. 8 is a perspective view illustrating use of an adapter bracket 82 in combination with the dock section 10 depicted in FIG. 1 suitable to selectively form either "L" or "T" shaped pier type or floating type docks. The adapter bracket 82 preferably is attached to the side of a dock section 10 using conventional hardware, e.g. self-tapping screws, carriage bolts, etc. Additional dock sections 10 can then be attached to the adapter bracket 82 via the latching system 16, 18, 36, 38 in a manner described herein above. This feature is useful to adapt multiple dock sections 10 to have a platform configuration on the end of the pier type or floating type dock generally preferred by those skilled in the art. Because most known and preferred dock configurations are used to provide access to various other water system apparatus, e.g. boat lifts, PWC floats, etc., the adapter bracket 82 can be combined with any one or more dock sections 10 to "T" off at various positions along the pier type or floating type dock. In this manner, the adapter bracket 82 provides nearly unlimited flexibility to attain multiple "T" and "L" configurations easily and simply.

Figure 9:
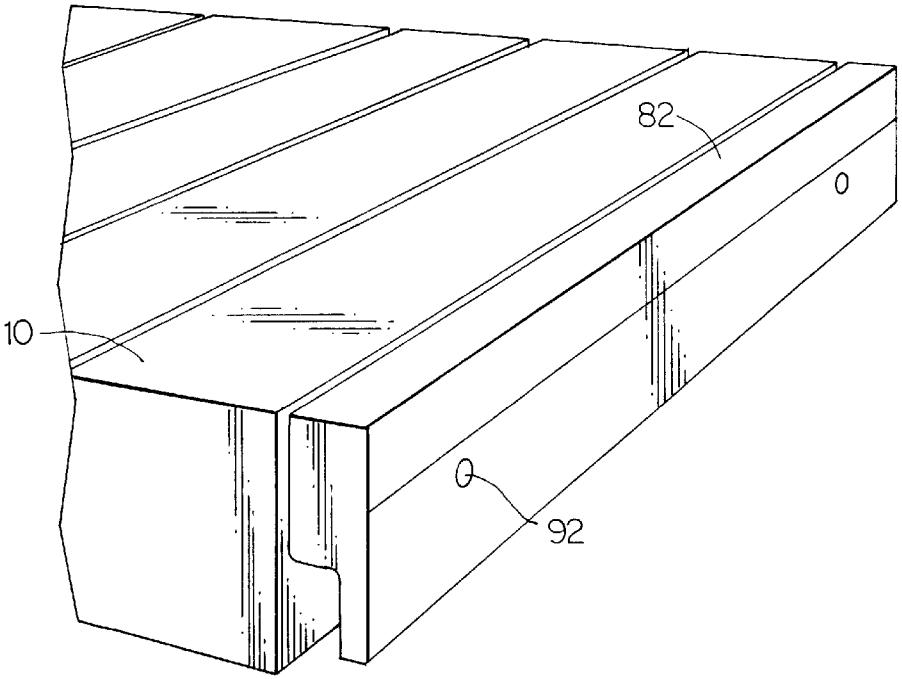
FIG. 9 is a perspective view illustrating use of an adapter bracket in combination with the dock section depicted in FIG. 1 suitable to form a final or end dock section.

FIG. 9 is a perspective view illustrating use of an adapter bracket 82 in combination with the dock section 10 depicted in FIG. 1 suitable to selectively form a final or end dock section of a pier type or floating type dock. When attached to the end of a dock section 10, the adapter bracket 82 serves as an end cap to provide an aesthetically enhanced pier type or floating type dock.

Figure 10:
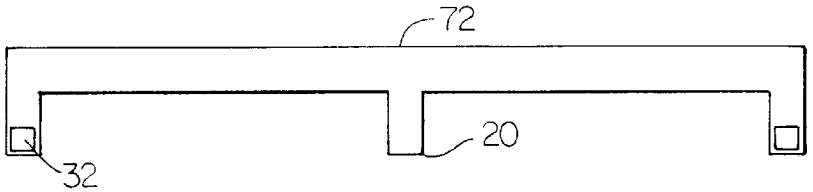
FIG. 10 is a simplified end elevational view of the shell for the dock section depicted in FIG. 1 illustrating structural support stringers.

FIG. 10 is a simplified end elevational view of the shell 72 for the dock section 10 depicted in FIG. 1 illustrating one preferred embodiment for the structural support beams 20. The present invention is not so limited to the particular embodiment shown however, and it will readily be appreciated that numerous other beam 20 configurations can be used to provide the necessary functional rigidity and stability. For example, although the configuration shown includes use of rectangular metal support stringers 32 inserted into the bottom portion of each side beam 20, other styles, shapes, locations and sizes, as well as materials, may just as well be employed to formulate the support stringers 32 used to bolster the structural integrity of a particular dock section 10.

This invention has been described herein in considerable detail in order to provide those skilled in the art with the information needed to apply the novel principles and to construct and use such specialized components as are required. In view of the foregoing descriptions, it should be apparent that the present invention represents a significant departure from the prior art in construction and operation. However, while particular embodiments of the present invention have been described herein in detail, it is to be understood that various alterations, modifications and substitutions can be made therein without departing from the spirit and scope of the present invention, as defined in the claims which follow. For example, it will be apparent to those skilled in the art that although particular dock shell 72 shapes, sizes and unique combinations of novel dock components have been illustrated, that many other shapes, sizes and combinations of the dock components will also work to provide the intended functions of selectively providing a portable pier type or floating type dock system which is maintenance free and easy to install.

We claim:

1. A portable pier dock system comprising:

at least one substantially rectangular molded linear low density ultraviolet light stabilized polyethylene dock shell, said dock shell filled with a buoyant polyurethane foam, said dock shell having a plurality of internally disposed substantially columnar truss members, said dock shell further having a downwardly facing latching flange disposed on one end and further having an upward facing latching flange disposed on its opposite end such that an upward facing latching flange disposed on a first dock shell is configured to removably receive a downwardly facing latching flange disposed on a second dock shell and further wherein said downwardly facing latching flange comprises at least one molded extension finger member disposed on a tip of said downwardly facing latching flange and wherein said upward facing latching flange comprises at least one molded pocket adapted to removably receive said at least one molded extension finger member; said portable pier dock system further comprising a plurality of support beam members longitudinally disposed between each end of said substantially rectangular dock shell wherein at least one support beam member within said plurality of support beam member has at least one rigid support stringer longitudinally disposed therein; said portable pier dock system further comprising at least one adapter member configured to removably mate with at least one of said upward facing latching flange and said downwardly facing latching flange to form and end pier dock section.

2. The portable pier dock system of claim 1 wherein said at least one adapter member is further adapted to removably mate with said at least one rigid support stringer such that additional dock shells can be coupled to said at least one dock shell to form at least one of a "T" shape dock system and a "L" shape dock system.

3. The portable pier dock system of claim 2 wherein said upward facing latching flange further comprises at least one molded lift pocket disposed on a lower surface of said upward facing latching flange.

4. A portable pier dock system comprising:

at least one substantially rectangular molded dock shell, said dock shell filled with a buoyant polyurethane foam, said dock shell having a plurality of internally disposed truss members, said substantially rectangular dock shell further having a self-aligning coupling means disposed on each end for removably coupling additional dock shells to said dock system wherein said coupling means comprises an upward facing flange disposed on one end of said substantially rectangular dock shell and downward facing flange disposed on the opposite end of said substantially rectangular dock shell; said portable pier dock system further comprising a plurality of support beam members longitudinally disposed between each end of said substantially rectangular dock shell wherein at least one support beam member within said plurality of support beam members has at least one rigid support stringer longitudinally disposed therein;

and further wherein said portable pier dock system further comprises at least one end cap adapted to removably mate with at least one of said upward facing latching flange and said downwardly facing latching flange to form an end pier dock section.

5. The portable pier dock system of claim 4 wherein said at least one end cap is further adapted to removably mate with said at least one rigid support stringer such that additional dock shells can be coupled to said at least one dock shell to form at least one of a "T" shaped dock system and a "L" shaped dock system.

6. The portable pier dock system of claim 5 wherein said upward facing latching flange further comprises at least one molded lift pocket disposed on a lower surface of said upward facing latching flange.

* * * * *